US005346121A

United States Patent [19]

Beales

[11] Patent Number: 5,346,121

[45] Date of Patent: Sep. 13, 1994

[54] WEB TUCK PAPERBOARD CARTON

[75] Inventor: Jonathan T. Beales, Memphis, Tenn.

[73] Assignee: International Paper Company, Purchase, N.Y.

[21] Appl. No.: 131,587

[22] Filed: Oct. 5, 1993

[51] Int. Cl.[5] ..... B65D 5/66

[52] U.S. Cl. ..... 229/148; 229/138; 229/147; 229/149; 229/159

[58] Field of Search ..... 229/138, 140, 144, 147, 229/148, 149, 159

[56] References Cited

U.S. PATENT DOCUMENTS

| | | | |
|---|---|---|---|
| 371,230 | 10/1887 | Trum . | |
| 1,644,782 | 10/1927 | Lander | 229/148 |
| 2,316,701 | 4/1943 | Marshall . | |
| 2,646,917 | 7/1953 | Smith | 229/140 |
| 2,675,164 | 4/1954 | Haas | 229/148 |
| 2,692,078 | 10/1954 | Lange . | |
| 2,692,721 | 10/1954 | Pennebaker et al. | 229/140 |
| 2,797,041 | 6/1957 | Rondone . | |
| 2,846,132 | 8/1958 | Carpenter | 229/144 |
| 2,918,205 | 12/1959 | Zeitter | 229/148 |
| 3,107,040 | 10/1963 | Ullger . | |
| 3,365,114 | 1/1968 | Macchi . | |
| 3,729,127 | 4/1973 | Kleinhaut . | |
| 4,201,331 | 5/1980 | Austin . | |
| 4,230,261 | 10/1980 | Austin . | |
| 4,307,834 | 12/1981 | Roccaforte . | |
| 4,341,341 | 7/1982 | Roccaforte . | |
| 4,471,904 | 9/1984 | Cassidy . | |
| 4,497,433 | 2/1985 | Wischusen . | |
| 4,530,459 | 7/1985 | Maroszek . | |
| 4,535,928 | 8/1985 | Capo . | |
| 4,607,786 | 8/1986 | Weaver | 229/138 |
| 4,969,596 | 11/1990 | Schulbaum . | |

*Primary Examiner*—Gary E. Elkins
*Attorney, Agent, or Firm*—Michael J. Doyle

[57] ABSTRACT

A paperboard container which displays particular utility for the packaging of fast food products is formed from a unitary blank of paperboard. The blank, typically, employs an automatic bottom, i.e., a bottom which is automatically formed upon opening the container from a folded or flattened configuration. The container is characterized by side webs between the top edges of the end panels and the top cover panel. Upon folding the top cover panel down to close the container, after being loaded with food, each side web forms a point or apex along its edge, this apex then tucked into a complementary slit in a respective end panel. Each side web is in frictional, surface to surface engagement with a respective end panel. Further, the top closure cover is provided with a friction latch cooperating with the front wall panel to thereby yield three points of frictional engagement to maintain the container in its closed position prior to being opened by the consumer.

4 Claims, 2 Drawing Sheets

WEB TUCK PAPERBOARD CARTON

BACKGROUND OF THE INVENTION

This invention relates to a container and more particularly to a container fashioned from a unitary blank of paperboard or other stiff, foldable and resilient sheet material. The container of this invention exhibits particular utility as a container for fast foods. Such containers must be inexpensive, easy to close and open, and capable to fairly easy disposal for recycling. They should also retain heat from food products therein and resist accidental opening prior to consumption of the packaged food.

The container art is aware of a variety of constructions employing a unitary blank of paperboard for forming a container. However, no one of these constructions exhibits the desirable features of the present invention.

SUMMARY OF THE INVENTION

According to the practice of this invention, a container for fast foods is fashioned from a unitary blank of paperboard and is in the general form of a rectangular tray having a top cover closure foldably secured to the tray rear side wall. A generally triangular side web is provided, between the side edges of the top cover panel and the top edges of each of the end walls or panels of the container, with a fold line in each of the these side webs. The construction is such that when the top closure panel is folded downwardly to close the container, after the latter is loaded with fast food products, each of the side web panels folds into yet another triangular shape, the folding occurring in an outward lateral direction, with an apex or point being formed by each side web panel. Each apex or point is placed into a slit in a respective end wall of the container, with each folded web being substantially parallel to and in surface frictional engagement with a portion of its respective slitted end wall. Further, a releasable latch in provided between a front closure flap carried by the top closure panel and the front side wall. This construction yields three releasable friction latches for holding the top cover of the container in a secured but releasable closed position. It is easy for the consumer to lift the front cover flap and lift up the front of the front cover panel from its three points of attachment to the bottom or tray portion of the container.

DETAILED DESCRIPTION OF THE INVENTION

Figure 1:
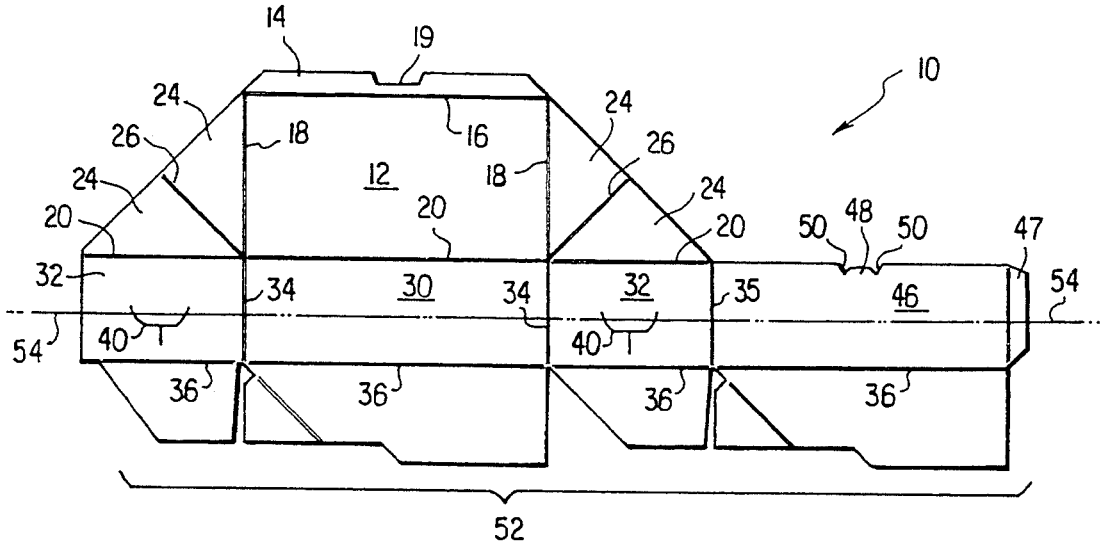
FIG. 1 is a plan view of a blank for forming the container of this invention.

Referring to FIG. 1 of the drawings, a unitary blank of paperboard or the like for forming the container of this invention is designated as 10. The blank includes a top cover panel 12 which is provided at its upper edge with a top closure flap 14, with panel 12 and flap 14 being joined by a horizontally extending fold line 16. Top closure flap 14 is provided with a cutout 19 which functions as one element of a front frictional latch for closing the container, as will later be described. The vertically extending sides of top cover panel 12 are designated as 18, the latter defined by fold lines and each of the latter intersects a fold line 20 which defines the bottom edge of top cover panel 12. Each of two triangular side webs or panels is formed by two triangular sections 24, the sections coupled by a diagonally extending fold line 26. Fold lines 26 extend from respective free slanting edges of these side web panels to the respective intersections of fold lines 18 and 20. The lower portions of triangular web sections 24 are foldably joined along the upper edges of end wall panels 32 by fold line 20. The rear side wall panel is designated as 30 and is bordered at its upper edge by fold line 20, at its lower edge by fold line 36, and at its ends by fold lines 34. Each end wall panel 32 includes generally half circular cuts 40, with a straight cut 42 extending vertically downwardly from and intersecting the central portion of each cut 40. A front side wall panel is designated as 46 and is bordered on its left by fold line 35 and carries on its right vertical edge a manufacturer's or glue flap 47. The upper, free edge of front side wall panel 46 carries a tongue 48 bordered and defined by latched notches 50 extending downwardly from the upper free edge of panel 46.

The bottom of the blank, i.e., the lower edges of the four colinear and serially foldably joined panels 32, 30, 32, and 46 carry bottom forming panels along fold line 36, the bottom forming panels designated as 52 and defining an automatic bottom wall forming configuration, known in this art. It will be understood that other known bottom wall container forming configurations may be employed in accordance with the practice of this invention. Colinear panels 32, 30, 32, and 46 are serially arranged along an imaginary horizontal axis 54.

Figure 2:
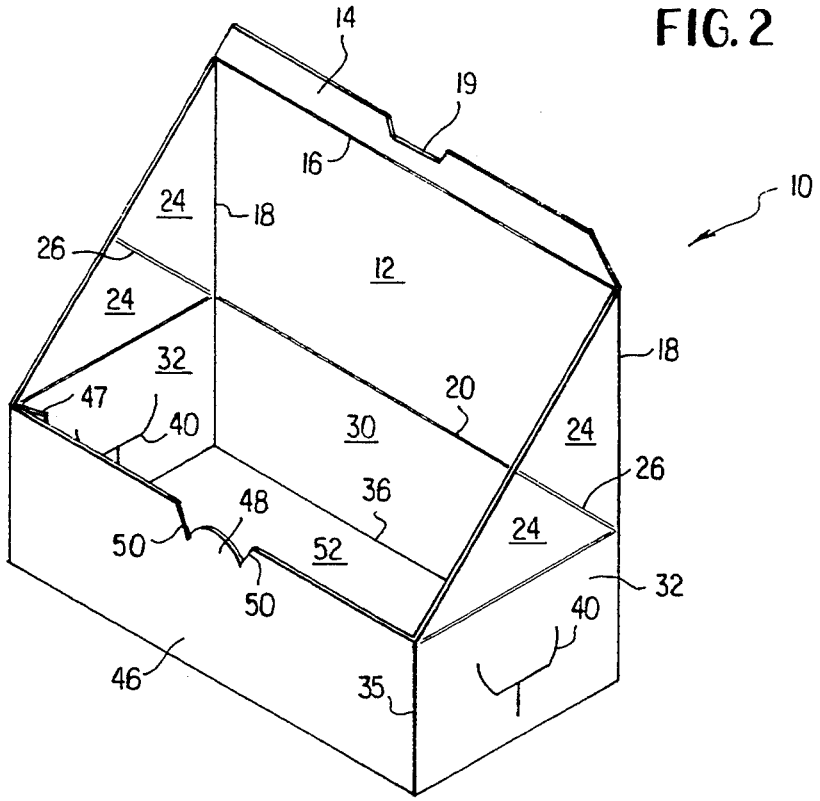
FIG. 2 is a perspective view showing the blank of FIG. 1 folded, glued and erected, the container being shown in its fully open configuration.

Referring now to FIG. 2 of the drawings, the blank 10 of FIG. 1 has been folded, glued and erected to assume the fully opened configuration of the container. The container is now ready to receive fast food or other product to be packaged.

Figure 3:
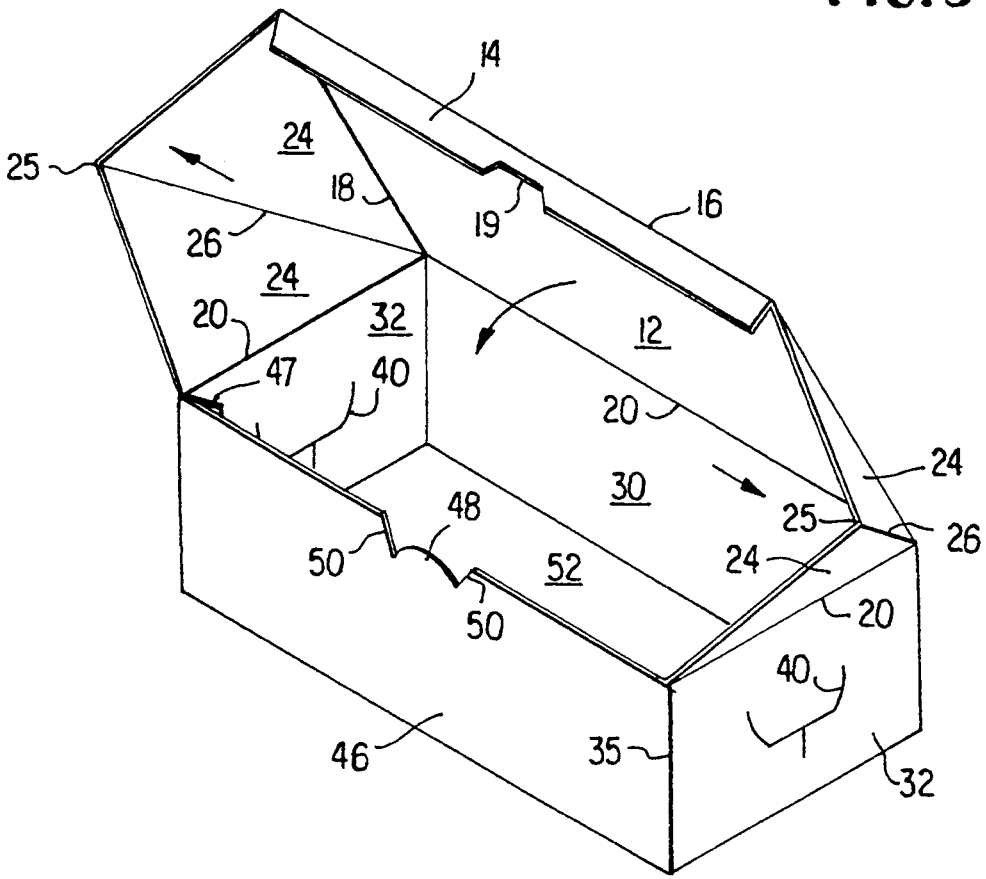
FIG. 3 is a view similar to FIG. 2 and shows the container of this invention as its top cover panel is being folded downwardly so as to close the container.

Referring now to FIG. 3, top cover panel 12 has been folded partially downwardly with each pair of the triangular webs 24 at each of the container sides bowing laterally outwardly, as indicated by the arrows. With continued folding, the triangular web panels 24 of each side pair become superposed and define a double thickness web having a free tip 25.

Figure 4:
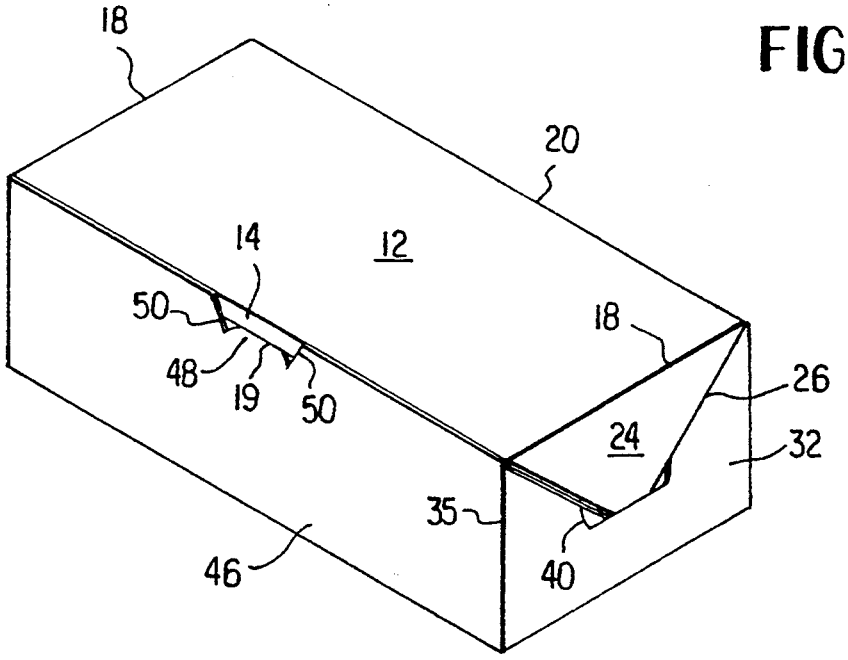
FIG. 4 is a view similar to FIG. 3 and shows the closed configuration.

Referring now to FIG. 4, cover 12 has been completely closed, with those portions of top closure flap 14 on either side of cutout 19 located inside the box, on the inside surface of front side wall 46. That portion of top closure flap 14 between cutout 19 and fold line 16 is in frictional surface contact with the upper outside portion of tongue 48. At more or less the same time during closing, the operator packaging the fast food places side web tips 25 of each of the side webs 24 into a respective slit 40 in a respective end wall 32. The lower triangular panel 24 of each side web panel pair (referring to FIG. 3) is thus in substantial parallelism and in frictional surface contact with the outside of each respective end wall. Tucking these tips 25 into slits 40 thus results in yet additional friction latches serving to hold the top cover 12 in its closed position of FIG. 4.

Geometrical terms of orientation such as horizontal, vertical, and the like have been used to facilitate the description and are not intended as terms of limitation.

I claim:

1. A unitary blank of paperboard for forming a rectangular parallelepiped container, said blank including first and second rectangular side and first and second rectangular end panels foldably joined in series by respective fold lines, said side and end panels being aligned and alternately arranged along a horizontal axis, each of said side and end panels having an upper edge and a lower edge, bottom forming panels foldably attached to said lower edges of at least some of said side and end panels, a top rectangular closure panel foldably attached to said upper edge of a first one of said side panels, said top closure panel having an upper edge foldably attached to a front closure flap, said top closure panel having two opposite vertical side edges, two triangular web panels each having a diagonal fold line and respectively foldably secured to respective said upper edges of each of said two end panels and to a respective said opposite side edge of said top closure panel, said top closure panel side edges being of a vertical extent at least as great as the horizontal extent of said rectangular end panels, each of said two end panels having a slit extending therethrough, means on said front closure flap and said upper edge of said other and second side panel to latch said front closure flap to said other side panel.

2. A paperboard container defining a rectangular parallelepiped and having exterior and interior surfaces and fashioned from a unitary blank of paperboard, said container having a bottom wall, a front side wall, a rear side wall, end walls and a top cover panel, said top cover panel defining an entire one of the said six wall and end panel surfaces of said rectangular parallelepiped, said top cover panel having two opposite side edges and a front edge, a respective generally triangular web latching flap of double thickness extending between each of said end walls and each of said side edges of said top cover panel, one apex portion of each of said web latching flaps extending through a respective said end wall by means of a slit in each said respective end wall, each said latching flap frictionally engaging a respective said end wall.

3. The container of claim 2 including a top cover latching flap carried by said top cover panel, said latching flap having a free edge, a recess in said latching flap free edge, said front side wall having a free edge and having a tongue along said front side wall free edge, a portion of said top cover panel latching flap engaging said tongue on a said exterior surface thereof and another portion engaging said front side wall at portions of said interior surface, whereby said top cover panel is maintained in a container closed configuration by three frictional zones.

4. The container of claim 2 wherein each of said end wall slits is of a downwardly convex form, and communicates with a vertical slit.

* * * * *